United States Patent [19]

Kunze, deceased et al.

[11] Patent Number: 4,844,276

[45] Date of Patent: Jul. 4, 1989

[54] VESSEL FOR RECEIVING A SUSPENSION CONTAINING SOLIDS

[75] Inventors: Peter Kunze, deceased, late of Geneva, Switzerland, by Antoinette Zucca-Kunze, heir; Nina Kunze, heir, Karlsruhe, Fed. Rep. of Germany; by Petra Kunze, heir, Karlsruhe, Fed. Rep. of Germany; by Jochen Kunze, heir, Karlsruhe, Fed. Rep. of Germany

[73] Assignee: Wiederaufarbeitungsanlage Karlsruhe Betriebsgesellschaft mbH, Eggenstein-Leopoldshafen, Fed. Rep. of Germany

[21] Appl. No.: 195,304

[22] Filed: May 18, 1988

[30] Foreign Application Priority Data

May 22, 1987 [DE] Fed. Rep. of Germany ..... 3717289

[51] Int. Cl.[4] ..... B65D 6/00

[52] U.S. Cl. ..... 220/5 A; 220/DIG. 29; 137/576; 137/592

[58] Field of Search ..... 220/5 A, DIG. 29; 137/576, 592, 237, 240, 241; 376/352, 347

[56] References Cited

U.S. PATENT DOCUMENTS

| | | | |
|---|---|---|---|
| 1,802,733 | 4/1931 | Murray, Jr. | 220/5 A |
| 1,835,015 | 12/1931 | Shanor | 220/5 A |
| 2,570,375 | 10/1951 | Pritchard | 137/576 |
| 3,038,841 | 6/1962 | Swartwout | 220/5 A |
| 4,161,963 | 7/1979 | Stevens | 137/592 |

*Primary Examiner*—A. Michael Chambers
*Attorney, Agent, or Firm*—Walter Ottesen

[57] ABSTRACT

The invention relates to a vessel for receiving suspensions containing solids such as radioactive liquids. The vessel includes a bottom wall inclined towards an outlet opening formed therein and a spraying arrangement in the vicinity of the inner walls. In order to reliably discharge solid deposits on the bottom of the vessel while using a minimum of flushing liquid, the bottom of the vessel is provided with a channel extending in the direction toward the outlet opening. A flushing tube pointing into the channel is provided at the highest elevation thereof. The solid/liquid mixture is flushed out of the vessel with great effectiveness by means of a directed delivery of the flushing liquid into the channel.

9 Claims, 3 Drawing Sheets

VESSEL FOR RECEIVING A SUSPENSION CONTAINING SOLIDS

FIELD OF THE INVENTION

The invention relates to a vessel for receiving suspensions containing solids such as radioactive liquids. The vessel has a base wall inclined towards an outlet opening formed therein and a spraying arrangement in the vicinity of the inner walls.

BACKGROUND OF THE INVENTION

When vessels filled with suspensions containing solids are emptied, solid deposits form on the bottom of the vessel to an increased extent, particularly with low filling levels. This is attributed to the fact that the agitating devices arranged in such vessels lose effectiveness as the filling level drops. However, it is necessary to discharge the deposits towards the outlet opening in order to reliably avoid accumulation of solids at the bottom of the vessel. This is especially the situation with vessels receiving radioactive liquids.

In nuclear reprocessing facilities, upright and lying circular vessels as well as annular vessels (so-called annular-slab vessels) are installed with the base walls thereof being at a slight inclination towards the discharge line. In this context, it has been proposed to mount spraying arrangements in the vicinity of the base wall or in the vicinity of the inner walls by means of which the solid deposits can be flushed out. In this connection, it is unsatisfactory that large amounts of flushing liquid are required for large vessels. These large amounts of flushing liquid required after emptying a vessel lead, with radioactive product solutions, to an undesirable increase of secondary waste, the removal of which is very costly. Another disadvantage is that the valuable substances of the radioactive product solution are present in a very highly diluted form because of the flushing liquid and this affects the economical processing of the product solution. Substantially increasing the inclination of the base of the vessel cannot be regarded as a satisfactory solution for reducing the amount of flushing liquid, since otherwise the height of the vessel would have to be considerably increased, especially with respect to annular vessels. This would require additional space which can be made available only at very high cost in a nuclear facility.

SUMMARY OF THE INVENTION

It is an object of the invention to reliably discharge solid deposits on the bottom of the vessel while using a minimal amount of flushing liquid.

According to the invention, this object is achieved by providing channel means formed in the base wall and extending in the direction toward an outlet in the base wall. Flushing means are arranged at the highest elevation of the channel means for directing a flushing liquid directly into said channel means for flushing away solids and residual liquid to the outlet.

Pursuant to the invention, the bottom of the vessel is provided with a channel which is so configured that the liquids and the solids are floated in this channel when discharging vessel residues and during the flushing operation. The channel is, in turn, inclined in the direction of the outlet opening so that the solids are conveyed by the residual liquid and flushing solution toward the outlet opening at an increased flow velocity.

By means of the channel, a defined area is established at the bottom of the vessel wherein settling solids, which are to be flushed, collect and from where they can be flushed with great effectiveness toward the outlet opening. The flushing tube is provided at the highest point of the channel and is mounted so that it points into the channel. With this flushing tube, a flushing liquid can be introduced in a targeted manner into the channel where it flushes out the solid/liquid mixture, which has washed into the channel, with great effectiveness. The amount of flushing liquid required for the flushing arrangement can be greatly reduced.

According to another feature of the invention, the channel means includes mutually adjacent channel walls defining a channel in the base wall of the vessel. The channel walls define respective channel wall angles with respect to a horizontal plane which are steeper than the angle at which the base of the vessel is inclined with respect to a horizontal plane. At least one of the channel wall angles is in the range of to 45° to 60° and the angle of inclination of the base wall is in of 3° to 5°. With these angles, it is possible to achieve a defined collection of the solids and flushing liquids in the channel.

According to another feature of the invention, the channel means formed in the base of the vessel can include mutually adjacent channel walls which conjointly define a semicircle when viewed in cross section. With this embodiment, internal edges within the vessel interior and possible deposition of solids at such edges are avoided. A good flushing out of the solids is ensured.

According to still another feature of the invention, the channel means can include mutually adjacent walls conjointly defining two walls of a triangle when viewed in cross section with the apex thereof directed downwardly. With this embodiment, a better conductance of the liquid to be flushed out is obtained compared to the last-mentioned embodiment.

The invention affords the important advantage that also with large vessels, accumulations of solids on the bottom of the vessel during prolonged operations can be reliably avoided by the application of small amounts of flushing solution. In this connection, it is particularly advantageous that dilution of the product solution is reduced. The increase of radioactive waste solutions is reduced.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
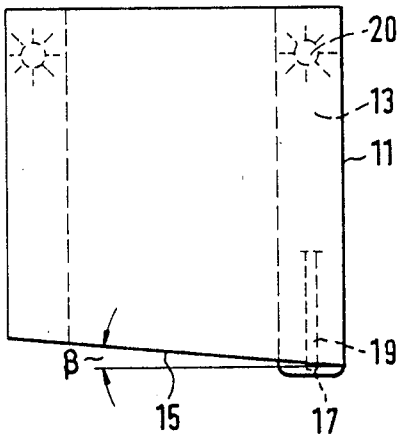
FIG. 1 is a side elevation view of an annular-slab vessel in accordance with the known state of the art.

FIG. 1 shows a so-called annular-slab vessel 11 with an annular space 13 receiving the suspension containing solids. The bottom 15 of vessel 11 is arranged at an angle of inclination $\beta$ of 3°. At the lowest point of the bottom 15 an outlet opening 17 is provided at which a discharge line 19 for emptying the vessel 11 is arranged. In the upper zone of the annular space 13 there is an annular spraying arrangement 20 provided with nozzle openings.

Figure 2:
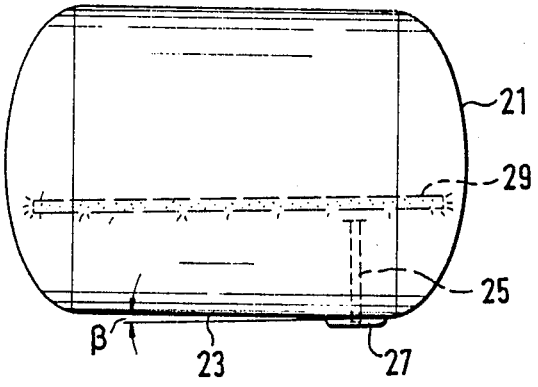
FIG. 2 is a side elevation view of a lying circular vessel in accordance with the state of the art.

The circular vessel 21 according to the known state of the art shown in FIG. 2 also has a bottom 23 with a slight inclination towards a discharge line 25 which dips into a sump 27. In the vicinity of the wall, spraying lines 29 are arranged having nozzle openings through which the inner walls can be flushed.

Figure 3:
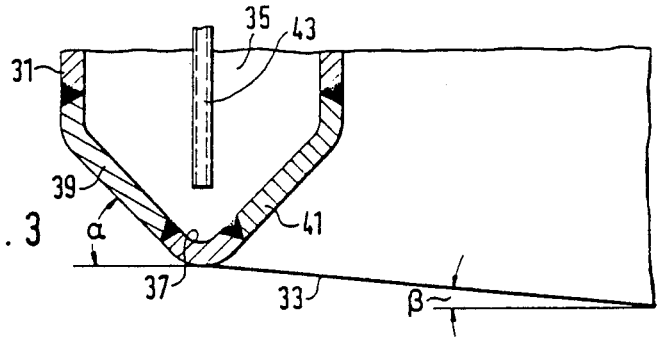
FIG. 3 is a first embodiment of an annular-slab vessel according to the invention with the vessel having a symmetrical channel.

In FIG. 3, a portion of an annular-slab vessel 31 is shown having a vessel bottom 33 which extends at a slight inclination toward a discharge line which cannot be seen in this view. The annular space 35 receiving the liquid has a symmetrical channel 37 in the area of vessel bottom 33. The channel walls 39 and 41 extend at a steeper angle $\alpha$ of inclination than the inclination of vessel bottom 33. In the embodiment shown, the angle of inclination $\alpha$ of the channel walls is 45° and the angle of inclination $\beta$ of vessel bottom 33 is 3° . A flushing tube 43 is provided at the uppermost point of channel 37. The annular spraying arrangement is not shown here and in FIGS. 4 to 6 since its configuration corresponds to the spraying arrangement 20 of FIG. 1.

Figure 4:
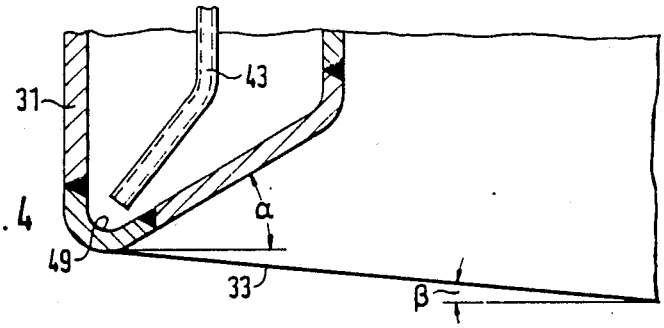
FIG. 4 is a second embodiment of an annular-slab vessel according to the invention with the vessel having an outwardly directed asymmetrical channel.

In FIG. 4, the annular-slab vessel 31 is provided at its bottom 33 with an outwardly directed asymmetrical channel 49. The flushing tube 43 is advantageously angled towards the outward-lying channel 49.

Figure 5:
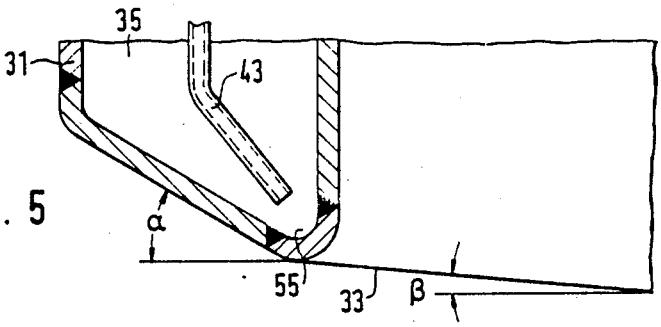
FIG. 5 is a third embodiment of an annular-slab vessel according to the invention with the vessel having an inwardly directed asymmetrical channel.

In FIG. 5, the vessel bottom 33 is provided with an inwardly directed channel 55. The flushing tube 43 is correspondingly angled inwardly.

Figure 6:
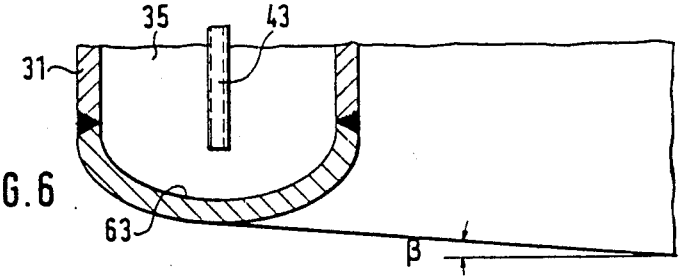
FIG. 6 is a fourth embodiment of an annular-slab vessel according to the invention with the vessel having a symmetrically rounded channel.

The embodiment of the annular-slab vessel 31 shown in FIG. 6 has a rounded channel-like configuration 63 of the wall defining the bottom of annular space 35. This embodiment is therefore a symmetrical channel configuration. The flushing tube 43 is arranged centrally at the highest point.

Figure 7:
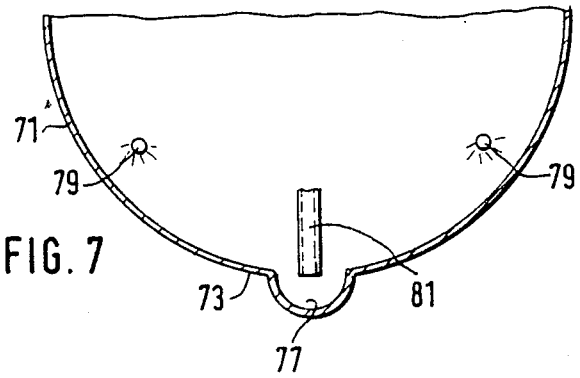
FIG. 7 is a cut-away view, partially in section, of an embodiment of a circular vessel according to the invention with the vessel having a semi-circular channel open at the top.
Figure 9:
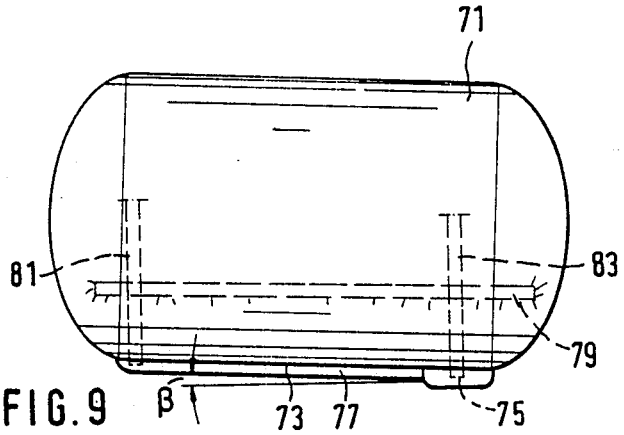

A cut-away portion of a lying circular vessel 71 is shown in FIG. 7 with the vessel bottom 73 thereof being at a slight inclination towards a discharge opening 75 (FIG. 9). A channel 77 of semi-circular cross section is arranged at the lowest point of the vessel bottom 73 and extends in the axial direction towards the outlet opening 75. Spraying lines 79 are arranged laterally along the inner periphery of the vessel by means of which the solid deposits can be flushed into the channel 77. A flushing line 81 is arranged at the highest point of channel 77 through which the content of channel 77 is flushed to the discharge line 83.

Figure 8:
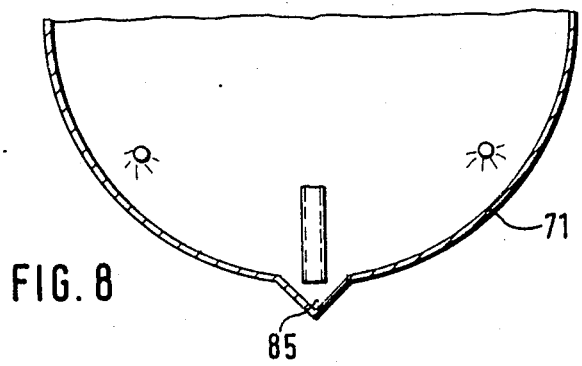
FIG. 8 is a cut-away view, partially in section, of another embodiment of a circular vessel according to the invention with the vessel having a channel with inclined walls; and, FIG. 9 is a side elevation view of a lying circular vessel according to an embodiment of the invention provided with a channel at the bottom thereof.

In FIG. 8, channel 85 at the bottom of a circular vessel 71 is configured in the form of an inverted triangle open at its base.

FIG. 9 shows that the flushing line 81 is arranged at the highest location of channel 77 of the lying circular vessel 71. The flushing line 81 is also at the highest location of channel 85 of the vessel shown in FIG. 8.

The method of operation of the vessel arrangement of the invention will now be described.

When it is desired to remove residues in an annular-slab vessel 31 having a channel (37, 49, 55, 63) configured as shown in FIGS. 3 to 6, respectively, the solids are flushed by means of an annular spraying arrangement 20 (FIG. 1) from the wall of the vessel in the direction of the particular channel (37, 44, 55, 63). The solids which have settled and are to be flushed out have collected in a defined area at the bottom of the vessel. By applying flushing solution through flushing tube 43 arranged at the highest point of channel (37, 49, 55, 63), the solids together with the residual liquid and flushing solution, are transported to the outlet opening at increased flow velocity.

The method of operation of the lying circular vessel 71 provided with a channel 77 or 85 is similar. The settling solids to be flushed out are flushed by means of the spray lines 79 defining a spraying arrangement into the particular channel 77 or 85 in the area of vessel bottom 73 and are transported from there at a high flow velocity, to the outlet opening 75.

It is understood that the foregoing description is that of the preferred embodiments of the invention and that various changes and modifications may be made thereto without departing from the spirit and scope of the invention as defined in the appended claims.

What is claimed is:

1. A vessel for receiving a suspension containing solids such as radioactive liquids, the vessel comprising:

a base wall having an outlet formed therein and said base wall being inclined downwardly toward said outlet at a predetermined base wall angle with respect to a horizontal plane;

side wall means extending upwardly from said base wall and defining inner wall surface means;

spraying means arranged in said vessel for spraying said wall surface means with a spraying solution;

channel means formed in said base wall and extending in a direction toward said outlet; and, flushing means arranged at the highest elevation of said channel means for directing a flushing solution directly into said channel means for flushing away solids and residual liquid to said outlet.

2. The vessel of claim 1, said channel means having mutually adjacent channel walls defining a channel in said base wall, said channel walls defining respective channel wall angles with respect to a horizontal plane which are steeper than said base wall angle.

3. The vessel of claim 2, at least one of said channel wall angles being in the range of 45° to 60° and said base wall angle being in the range of 3° to 5°.

4. The vessel of claim 1, said channel means including mutually adjacent channel walls conjointly defining a semicircle when viewed in cross section and open at the upper end thereof.

5. The vessel of claim 1, said channel means including mutually adjacent walls conjointly defining two walls of a triangle when viewed in cross section with the apex thereof directed downwardly.

6. The vessel of claim 1, wherein the vessel is an annular vessel defining a toroidal-like interior for receiving said suspension therein, and said channel means defining the base wall of said container.

7. The vessel of claim 6, said channel means having mutually adjacent flat channel walls which are symmetrical when viewed in cross section.

8. The vessel of claim 6, said channel means having mutually adjacent curved channel walls which are symmetrical when viewed in cross section.

9. The annular vessel of claim 6, said vessel having inner and outer annular walls conjointly defining said toroidal-like interior, said channel means having mutually adjacent channel walls extending downwardly from respective ones of said inner and outer annular walls, and said channel walls being asymmetric with respect to said annular walls when viewing said channel walls in cross section.

* * * * *

UNITED STATES PATENT AND TRADEMARK OFFICE

CERTIFICATE OF CORRECTION

PATENT NO. : 4,844,276

DATED : July 4, 1989

INVENTOR(S) : Peter Kunze, deceased

It is certified that error appears in the above-identified patent and that said Letters Patent is hereby corrected as shown below:

In column 2, line 21: insert -- the range -- between "in" and "of 3°".

Signed and Sealed this

Tenth Day of April, 1990

*Attest:*

HARRY F. MANBECK, JR.

*Attesting Officer*

*Commissioner of Patents and Trademarks*